United States Patent [19]

Rizzardi

[11] Patent Number: 5,038,951

[45] Date of Patent: Aug. 13, 1991

[54] CLOSURE FOR MONODOSE BOTTLES AND THE LIKE, COMPRISING A RESERVOIR PROVIDED WITH A BREAKABLE BOTTOM

[76] Inventor: Napoleone Rizzardi, Via Zambeletti, 10, 20129 Milan, Italy

[21] Appl. No.: 340,560

[22] Filed: Apr. 18, 1989

[30] Foreign Application Priority Data

Apr. 18, 1988 [IT] Italy ..... 21803/88[U]
May 12, 1988 [IT] Italy ..... 21229/88[U]

[51] Int. Cl.[5] ..... B65D 25/08

[52] U.S. Cl. ..... 215/256; 215/251; 215/DIG. 8; 206/222

[58] Field of Search ..... 206/222; 215/DIG. 8, 215/251, 252, 256

[56] References Cited

U.S. PATENT DOCUMENTS 3,156,369 11/1964 Bowes et al. ..... 206/222
3,603,469 9/1971 Magni ..... 206/222
3,840,136 10/1974 Lanfranconi et al. ..... 206/222 X
4,195,731 4/1980 Cavazza ..... 206/222
4,387,818 6/1983 Conti ..... 215/256
4,565,294 1/1986 Smith ..... 215/256 X
4,592,475 6/1986 Hannon et al. ..... 215/252
4,815,620 3/1989 Bullock ..... 215/256

*Primary Examiner*—Stephen Marcus
*Assistant Examiner*—Nova Stucker
*Attorney, Agent, or Firm*—Michael J. Striker

[57] ABSTRACT

A closure of plastic material for monodose bottles and the like, provided with a reservoir (2) with a breakable bottom (3) housed in the neck (4) of the bottle (5) and showing an annular upper edge (6) superimposed to the annular edge (7) of the bottle opening; with a cylindrical element (8) with its lower end (9) sideways cut inserted into the reservoir (2) and including further a sealing cap (10) positioned around the bottle neck (4) and covering said cylindrical element (8), a weakening line apt to allow the tearing removal being provided in said cap.

6 Claims, 2 Drawing Sheets

CLOSURE FOR MONODOSE BOTTLES AND THE LIKE, COMPRISING A RESERVOIR PROVIDED WITH A BREAKABLE BOTTOM

The object of said invention is a closure of plastic material for monodose bottles and the like, of the kind enclosing a reservoir housed in the bottle neck and containing a substance, generally in a powder-form, which is dropped into the liquid contained in the bottle, by breaking said reservoir.

The bottom breaking takes place acting on a pressing element, provided with a cylindrical body, penetrating the reservoir with an end sideways cut; said operation is executed after the removal of a sealing cap covering and protecting the whole against any accidental blow or tampering.

The sealing cap may be made of aluminium or plastic, which is the case of said invention.

Said kinds of bottles being monodose, the sealing cap, once removed, must not be re-employed.

Therefore it is the matter of rendering easier the removal of the sealing cap to the user.

The known sealing caps, of plastic material, usually show a grip tongue; by pulling it, a sealing wrapper is removed or the cap breaking is caused along fixed breaking lines.

Said known caps are unlikely manually removable, as it is rather difficult to seize the tear tongue with a nail and exists a certain resistance in the tearing start.

Therefore, most times, a tool is used to open the cap.

Purpose of said invention is to eliminate the above mentioned inconveniences, by proposing a sealing cap of plastic material for closures with a reservoir provided with a breakable bottom, said sealing cap being simply made and utilized in an extremely easy way.

The closure according to said invention comprises a first cylindrical section folded around the bottle neck and a second cylindrical section with a reduced diameter, covering the pressing element, said sections being interconnected for example by means of connecting bridges.

A substantially upright weakening or prefracturing line is provided on the cap cylindrical section positioned around the bottle neck; close to said line is positioned a grip tongue for the cap break and removal.

By exerting a traction on the grip tongue, the cut of the cylindrical section thereof positioned around the bottle neck is produced along said weakening or prefracturing line, and subsequently the breaking of said connecting bridges and therefore the total or partial severance of the two cylindrical sections.

According to a further embodiment, the closure shows a breaking line substantially upright developing for the whole length of the sealing cap cover and circumferencially extending along the cap upper plane wall, into the area connecting the latter to the cover.

Close to the breaking line section interesting the cap cover, a grip tongue is provided to facilitate the removal of the latter.

By exerting a traction on the grip tongue, the cover cut is initially produced and therefore the total or partial severance thereof from the upper plane wall of the cap.

The cap is folded around the bottle neck by means of a continuous or discontinuous annular raising, provided close to its lower edge, showing its inner surface inclined in order to constitute an inducement during the cap application to the bottle.

Said continuous or discontinuous annular raising may be also obtained in the form of flexible tabs which resiliently close around the bottle neck.

From the cap upper wall a tubular projection comes down, which covers the pressing element and rests lower down on the reservoir annular edge in order to avoid that accidental blows on said cap upper wall are transmitted to the pressing element at the risk of breaking the reservoir breakable bottom.

Further features of said invention will become apparent in the following detailed description, referred to an exemplificative but not limitative embodiment, shown in the enclosed drawings, wherein.

Figure 1:
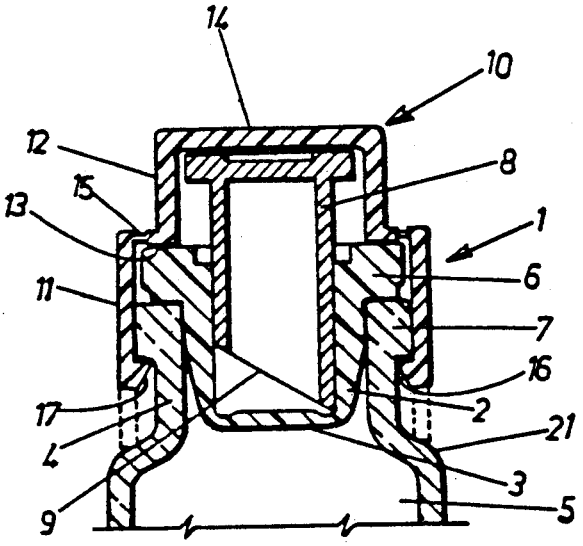
FIG. 1 is a median sectional view of the closure according to the invention, applied to a bottle.
Figure 2:
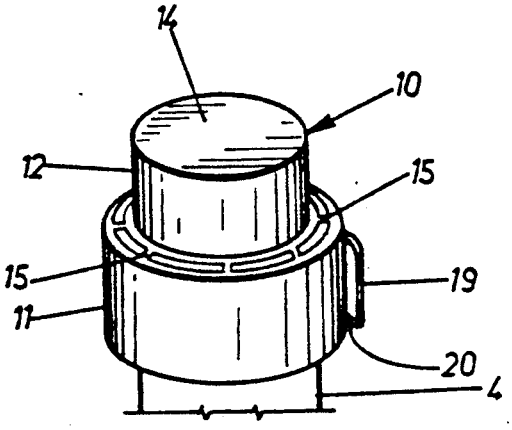
FIG. 2 is an axonometric view of the closure shown in FIG. 1.
Figure 3:
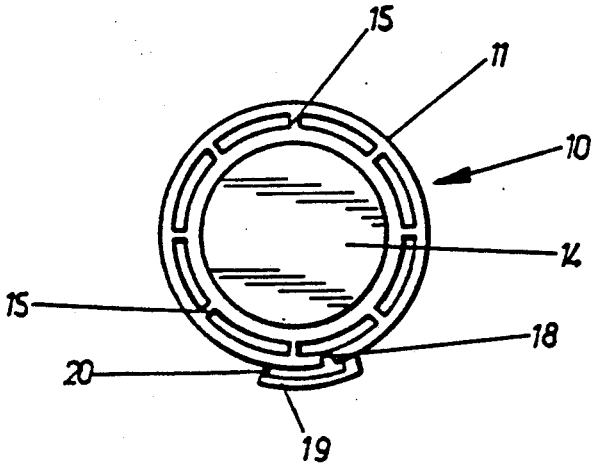
FIG. 3 is a top plan view of the sealing cap before the breaking.

As regard to FIGS. 1–3, reference 1 shows the whole closure according to the invention, enclosing a reservoir 2, provided with a breakable bottom 3 lodges by forcing into the neck 4 of a bottle 5 and shows on the upper part an annular edge 6 superimposed to the annular edge 7 of the bottle opening.

Into the reservoir 2 a cylindrical hollow element 8 is housed with its lower end 9 sideways cut.

During the use, the pressing of the cylindrical element 8 downwards causes the breaking of the breakable bottom 3, which drops a powder substance contained in the reservoir 2 into the liquid contained in the bottle 5, to which it has to be mixed.

Both the reservoir 2 and the cylindrical element 8 are of plastic material and are enclosed in a sealing cap 10, of plastic material too.

The cap 10 shows a lower cylindrical section 11 covering at least the upper part of the bottle neck 4 and an upper cylindrical section 12, of a reduced diameter, covering the pressing element 8.

The reduced diameter of the cylindrical section 12 causes the resting of its lower edge 13 on the annular edge 6 of the reservoir 2, in order to avoid that accidental blows on the upper part 14 of the cap 10 are transmitted to the cylindrical element at the risk of breaking the breakable bottom 3.

The two cylindrical sections 11 and 12 are interconnected each other by connecting bridges 15 which are broken during the cap opening.

It is anyway evident that the connection between the two cylindrical sections 11 and 12 may take place also through a material weakening line.

Close to the lower edge of the cylindrical section 11 a continuous or discontinuous inner annular raising 16 is provided engaging, owing to a transitory elastic deformation, below the annular edge 7 of the bottle opening.

The annular raising 16 shows an inner inclination or chamfer 17 apt to facilitate the application of the cap on the bottle.

The raising 16 may be made of solid material, as shown in FIG. 1, or in the shape of flexible tabs, so as to have a greater elasticity.

Always on the lower cylindrical section 11 of the cap 10 a weakening or pre-fracturing line 18 is provided extending substantially upright all over the length of section 11; close thereto there is positioned a grip tongue 19 to facilitate the cap removal.

The free end of the tongue 19 is connected to the cylindrical section 11 by means of a bridge 20.

The removal of cap 10 takes place by exerting a traction on the grip tongue 19, initially causing the breaking of the bridge 20 and subsequently the breaking of the weakening or pre-fracturing line 18 and at last the breaking of the bridges 15 connecting the two cylindrical sections 11 and 12.

The cylindrical section 11 of the cap 10 may stop with its lower edge immediately below the annular edge 7 of the bottle opening, as shown by continuous lines in FIG. 1 or continue up to the bottle shoulder 21, as shown by dashed lines in the said FIG. 1.

Said last solution secures in any case the cap breaking when the withdrawal from the bottle is tried without acting on the grip tongue 19.

Figure 4:
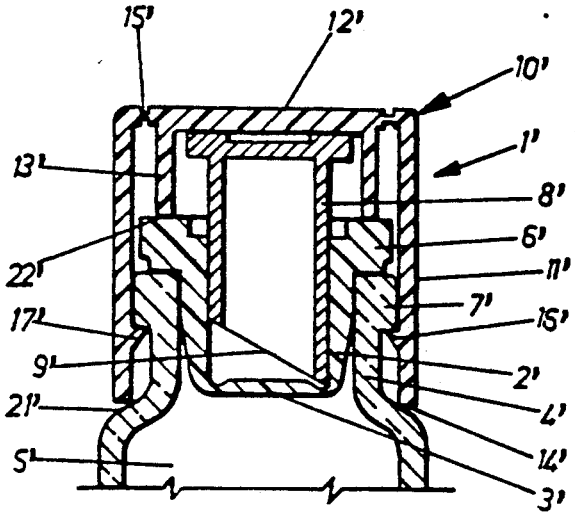
FIG. 4 is a median sectional view of a second preferred embodiment of the closure according to the invention, applied to a bottle.
Figure 5:
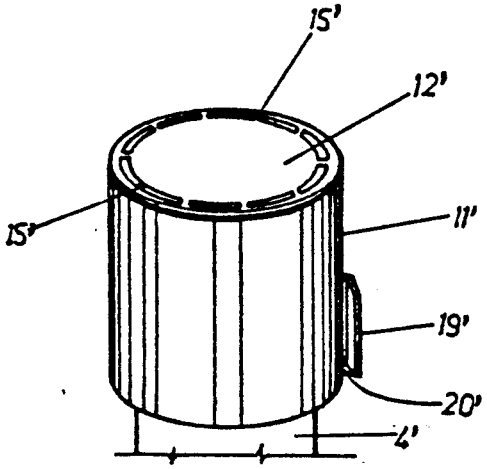
FIG. 5 is an axonometric view of a second preferred embodiment of the closure shown in FIG. 1.
Figure 6:
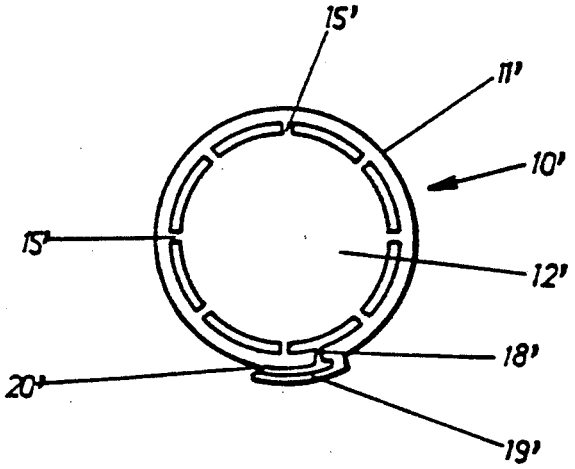
FIG. 6 is a top plan view of a second preferred embodiment of the sealing cap before the breaking.

In the version of FIGS. 4–6 , the cap 10' shows a peripheral cover 11' positioned around the bottle neck 2' and an upper plane wall 12', connected with the cover 11' by means of connecting bridges 15', so as to provide a circular breaking line, a shown in the enclosing figures.

It is anyway evident that the connection between the cover 11' and the cap upper wall 12' may take place also by means of a material weakening line.

Inside the cover 11' a continuous or discontinuous annular raising 16' is provided engaging, owing to a transitory elastic deformation, below the annular edge 7' of the bottle opeing.

The cover 11' of the cap 10' may stop with its lower edge 14' immediately below the annular edge 7' of the bottle opening or, more appropriately, continue up to the bottle shoulder 21', as shown in FIG. 4.

Said last solution secures in any case the cap breaking, when the withdrawal from the bottle is tried without carrying out the right opening operations, which shall be explained afterwards.

On the cover 11' of the cap 10' a weakening or pre-fracturing line 18' is provided extending substantially upright all over the length of said cover and connected to the circular breaking line provided on the cap upper plane wall 12'.

Close to the weakening or pre-fracturing line 18', and preferably in the lower part of the cover 11', a grip tongue 19' is provided apt to facilitate the cap removal, the free end of the tongue 19' being connected with the cover 11' by means of a bridge 20' (see particularly FIG. 6).

At last from the upper plane wall 12' of the cap 10' a continuous or discontinuous tabular inner projection 13' comes down surrounding the upper part of the cylindrical element 8'.

The lower edge 22' of the tubular projection 13' is resting on the annular edge 6' of the reservoir 2', so as to avoid that accidental blows on the cap upper wall 12' are transmitted to the cylindrical cap 8' at risk of breaking the breakable bottom 3'.

The removal of the cap 10' takes place by exerting a traction on the grip tongue 19', initially causing the breaking of the bridge 20', subsequently the breaking of the weakening or pre-fracturing line 18' provided on the cover 11' and at last the breaking of the bridges 15' connecting the cover 11' to the cap upper plane wall 12'.

Changes in detail may be introduced without departing from the scope of the invention.

I claim:

1. A closure of a plastic material for monodose bottles and the like provided with a reservoir located in a bottle neck and having an upper annular edge superimposed onto an annular edge of a bottle opening, and a breakable bottom, and a cylindrical element inserted in the reservoir and having a sideways cut lower end, said closure comprising a sealing cap positioned around the bottle neck and covering the cylindrical element, said sealing cap having a flat wall, an upright extending cover, a tubular projection extending inwardly of said flat wall and having an inner end engaging the upper annular edge of the reservoir, a first weakening circular line separating said flat wall from said cover for enabling opening of said sealing cap, and a second weakening line extending substantially upright along a whole height of said cover and connected with said first weakening line.

2. A closure as set forth in claim 1, wherein said sealing cap comprises a gripping tongue arranged adjacent to the second weakening line and having a free end and a bridge connecting said free end with said cover.

3. A closure as set forth in claim 1, wherein said cover is provided on an inside thereof with one of a continuous annular raising and a discontinuous annuular raising for engaging the bottle annular edge and having a chamfered portion that engages the bottle annular edge upon placing the cap over the bottle.

4. A closure as set forth in claim 3, wherein said raising comprises a solid portion.

5. A closure as set forth in claim 1, wherein said cover has a lower edge extending beyond the bottle annular edge.

6. A closure as set forth in claim 5, wherein said lower edge of said cover engages a shoulder of the bottle.

* * * * *